United States Patent [19]

Wannenwetsch

[11] Patent Number: 4,648,369

[45] Date of Patent: Mar. 10, 1987

[54] PRESSURE VALVE

[75] Inventor: Peter Wannenwetsch, Stuttgart, Fed. Rep. of Germany

[73] Assignee: Robert Bosch GmbH, Stuttgart, Fed. Rep. of Germany

[21] Appl. No.: 720,771

[22] Filed: Apr. 8, 1985

[30] Foreign Application Priority Data

May 10, 1984 [DE] Fed. Rep. of Germany ..... 3417210

[51] Int. Cl.[4] ..... F02M 39/00

[52] U.S. Cl. ..... 123/467; 123/506; 137/493.3; 417/296

[58] Field of Search ..... 123/467, 506, 446, 447; 137/493.3, 493.6, 516.27; 417/296

[56] References Cited

U.S. PATENT DOCUMENTS

| | | | |
|---|---|---|---|
| 2,706,490 | 8/1955 | Grieshaber | 137/516.27 |
| 3,195,465 | 7/1965 | Hug | 417/296 |
| 3,309,024 | 3/1967 | Maddalozzo | 137/493.6 |
| 3,477,458 | 11/1969 | Maddalozzo | 137/493.3 |
| 3,896,845 | 7/1975 | Parker | 137/493.3 |
| 3,933,132 | 1/1976 | Rishishita | 123/467 |
| 3,965,876 | 6/1976 | Tissot | 123/467 |
| 4,467,767 | 8/1984 | Kampichler | 123/467 |

FOREIGN PATENT DOCUMENTS

| | | | |
|---|---|---|---|
| 2107000 | 4/1983 | United Kingdom | 123/506 |

*Primary Examiner*—Carl Stuart Miller
*Attorney, Agent, or Firm*—Edwin E. Greigg

[57] ABSTRACT

A pressure valve is proposed which is installed in the supply line which leads from a fuel injection pump to a fuel injection valve. The pressure valve has a return-feed collar provided with a throttle connection and a relief conduit is provided parallel to the return-feed collar and to the valve closing member sealing face. Via a check valve and a throttle, the relief conduit establishes the communication between the supply line toward the injection pump and the supply line toward the injection valve. By means of the combination of the return-feed collar having a throttle with a check valve acting as a pressure maintenance valve, a desired residual pressure can be established in an adapted manner in the supply line toward the injection valve, and the injection duration in particular can be adapted to the requirements of a fuel injection pump which pumps at a reduced feed rate during idling operation.

9 Claims, 1 Drawing Figure

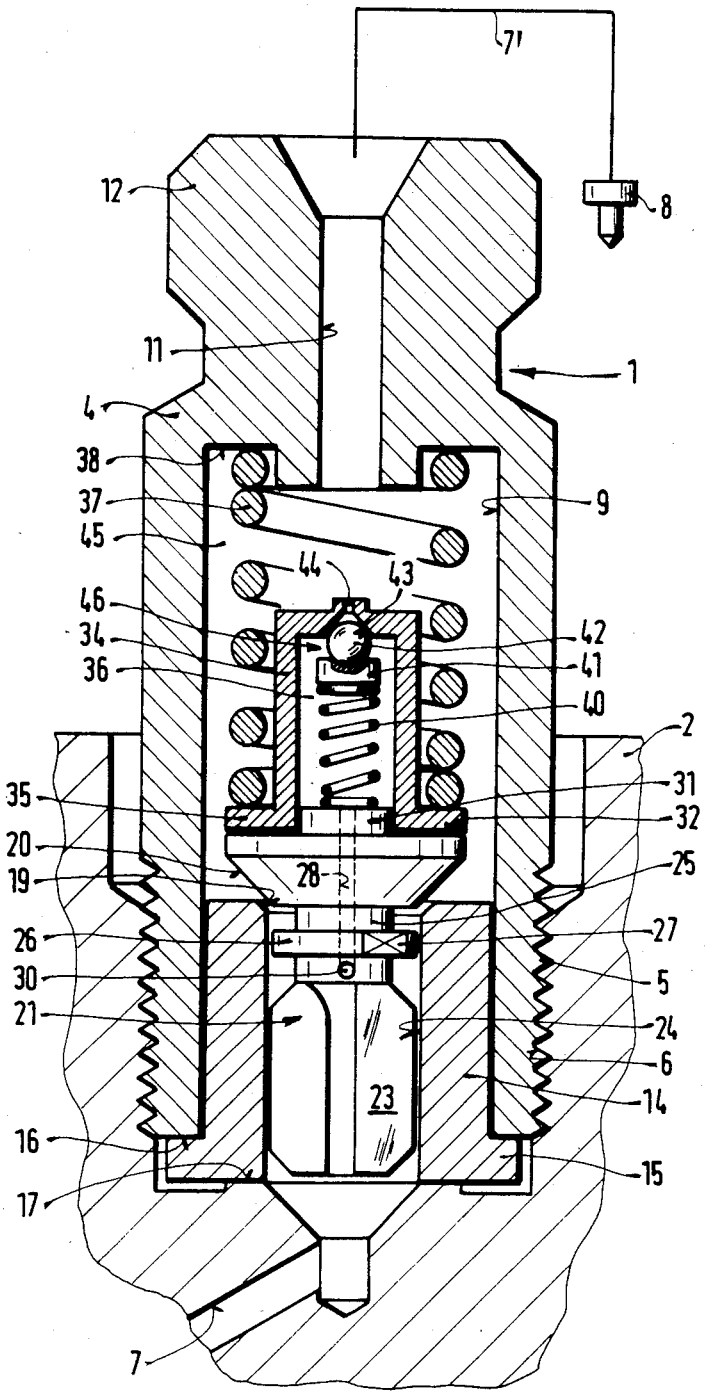
71
12
8
11
1
4
38
37
9
45
44
43
46
34
42
36
41
40
2
35
31
32
20
25
19
28
26
27
30
5
21
24
6
23
14
16
15
17
7

PRESSURE VALVE

BACKGROUND OF THE INVENTION

The invention is based on a pressure valve as defined hereinafter. In such a pressure valve, known from Swiss Pat. No. 394 710, the prevention of post-dripping or post-injection of fuel after the end of the effective supply stroke of the injection pump piston is to be attained by providing a return-feed collar on the pressure valve, in combination with a relief throttle, which may as needed be controlled by a pressure maintenance valve. Without this provision, pressure waves in the fuel supply line between the pressure valve and the injection valve, which travel back and forth between the injection valve and the pressure valve, would arise after the end of the effective supply stroke of the pump piston and the subsequent closure of the pressure valve and the high-pressure injection valve. The waves reflected from the pressure valve to the injection valve and back are capable of opening the injection valve after the proper time, causing fuel to escape and resulting in the known disadvantages of such a phenomenon.

In this known pressure valve, the use of a return-feed collar alone is effective in preventing this disadvantageous effect only in the case of small injection quantities per injection stroke of the pump piston. The known embodiment has the sole purpose of preventing post-injection or post-dripping, in fact over a wide range of injection quantity control per injection stroke. In this embodiment, at times when the relief throttle is not controlled by a pressure maintenance valve, has the effect that the residual pressure in the fuel supply line varies severely with the rpm. With small fuel injection lines, the supply line between the pressure valve and the injection valve is relieved in the same manner as with large injection quantities. During the ensuing supply stroke, there is then a displacement volume of variable quantity, which must be filled by the pump piston feeding action until the injection pressure at the injection valve is attained. Especially with small injection quantities, this has the disadvantage, first, of notable deviations in fuel quantity because of the variable residual pressures, which impairs the smoothness of engine operation, and second, that part of the useful stroke of the pump piston is lost, or becomes ineffective.

This becomes particularly disadvantageous if the fuel injection pump is equipped with a so-called quiet operation device, which is intended to reduce the pumping rate of the pump piston. To this end, in a known manner, a portion of the fuel pumped by the pump piston is withdrawn, and the duration of pumping is lengthened in order to attain the desired injection quantity. For a long pumping duration, on the other hand, a long pump piston supply stroke is necessary for this quiet operation range, which as a rule corresponds to the engine idling range. Now if a portion of the effective supply stroke of the pump piston is required to fill the displacement volume, then the required total stroke of the pump piston for adhering to even large full-load injection quantities must be designed to be quite long, which is disadvantageous in terms of the structure and size of the fuel injection pump.

It is also known, from U.S. Pat. No. 2,706,490, in a pressure valve which is provided with a return-feed collar by means of which the fuel supply line can be relieved after the end of injection, for a throttle connection to be provided on the return-feed collar. A pressure valve closing member embodied in this way is provided for internal combustion engines which are to be driven with liquid and gaseous fuel simultaneously. The liquid fuel is injected in a very small quantity, as igniting fuel, into the combustion chambers of the engine and made to ignite. As a result, the gaseous charge is then ignited as well. At the same time, however, such an engine is also intended to be drivable with liquid fuel over its entire operating range. The throttle connection on the pressure valve closing member is intended to prevent the valve closing member from lifting, during the injection of igniting fuel, by the amount that would correspond to the relief volume without the throttle. Thus the intent is to prevent the fuel supply line from being relieved, at the end of injection, by the full amount of the relief volume made available by means of the relief collar. This relief would affect operation in an unsatisfactory manner. By means of the throttle connection, the relief is to be precluded completely in the operating range in which igniting fuel is to be injected, in that the igniting fuel quantity bypasses the relief collar via the throttle connection without effecting a significant pressure drop. Contrarily, during operation with liquid fuel only, the relief is intended to be fully effective by means of the return-feed collar.

This arrangement has the disadvantage, however, that it does not allow variation of the injection quantity over a very wide variation range. With large injection quantities and operation entirely with liquid fuel, the effect of the return-feed collar is reduced considerably by the throttle connection. With large injection quantities per stroke and low rpm, high fuel supply line residual pressures can still arise, however, causing pressure waves which are reflected by the pressure valve and cause an uncontrolled opening of the injection valves. The fuel that belatedly escapes undergoes poor preparation, enters the combustion chamber too late, and no longer participates fully in the combustion process. This causes smoky combustion and carbonizing of the nozzles, and nozzle carbonizing in turn is associated with a further prolongation of the injection times. Accordingly, engine operation and combustion efficiency are impaired.

OBJECT AND SUMMARY OF THE INVENTION

The pressure valve according to the invention and has the advantage over the prior art that by means of the check valve, the pressure in the supply line is generally limited to a maximum value which is smaller than the opening pressure of the fuel injection valve, thereby preventing post-injection. By means of the embodiment of the return-feed collar, it is attained that with small injection quantities, or at a low feed rate of the fuel pumped from the pump work chamber to the injection valve, the fuel is capable of overflowing via the throttle connection, without thereby substantially raising the pressure valve closing member from its seat. The relief stroke, that is, the action of the relief collar upon closure of the pressure valve, is then correspondingly small, so that a relatively high residual pressure is maintained in the supply line. However, the action of the check valve is essential here in order to prevent this residual pressure from exceeding the opening pressure of the injection valves. At relatively large injection quantities or high feed rates, or at relatively high rpm, the throttling action of the throttle connection increases in such a manner that fuel quantities affecting the movement of the pressure valve closing member virtually no longer overflows at this location. In the partial-load range or full-load range, the return-feed collar thus becomes fully effective, such that even the action of the check valve is no longer of major significance in terms of maintaining a residual pressure below the nozzle opening pressure.

Since at a low feed rate a relatively high residual pressure can be adhered to in the supply line, the idle displacement volume is accordingly reduced as well. Thus with an unvaried injection quantity, a uniformly long feed, or pumping, phase of the pump piston is attained. This is significant particularly if the engine is operated with a so-called quiet operation device mentioned above. In injection pumps of this kind, the fuel supply is intended to begin at the same time as the effective supply stroke of the pump piston, in order to adhere to a precise injection onset, which also has an effect on noise. This applies particularly to the critical range of idling and low load and is attained by means of the high residual pressure that is attainable with the invention. A loss of useful stroke, which is particularly disadvantageous for idling operation, is thereby avoided as well. With the embodiment according to the invention, the demands made on an internal combustion engine in all operating ranges, particularly on an engine operated with a quiet operation device, can be met, and the working capacity in terms of the useful stroke of the fuel supply apparatus can be optimally exploited. By means of the residual pressure in the supply line that is controllable with the pressure valve according to the invention, the injection duration can be varied arbitrarily, at a given injection valve outlet cross section.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows in cross section an exemplary embodiment of a pressure valve according to the invention.

DESCRIPTION OF THE PREFERRED EMBODIMENT

The drawing shows a longitudinal section through a pressure valve 1, which is screwed into the housing 2 of a fuel injection pump not otherwise shown, which may for instance be designed in accordance with German Offenlegungsschrift No. 23 53 737. The pressure valve 1 has a connection pipe 4, which at one end has an outer thread 5 and is screwed therewith into a threaded bore 6 in the housing 2. A supply line 7 leading from the pump work chamber, not shown, of the fuel injection pump discharges into the threaded bore 6. This supply line 7 communicates via the pressure valve 1 with a continuing supply line 7', to the end of which an injection valve 8 is connected.

The connection pipe 4 is substantially cylindrical in structure and has an axial cylindrical recess 9, which is open toward the insertion end. Leading coaxially away from the cylindrical recess 9 is a connection bore 11, which discharges into a connection nipple 12 of the connection pipe 4 and connects the recess 9 with the supply line 7', and in turn with the injection valve 8.

A tubular valve seat body 14 is inserted into the axial recess 9 from the direction of the end toward the pump work chamber. On this end, the valve seat body 14 has a collar 15, via which it is held, by means of the connection pipe end face 16 on a shoulder 17 on the bottom of the threaded bore 6. On the end protruding into the axial recess 9, the tubular valve seat body 14 has a valve seat 19, on which a conical sealing face 20 of a valve closing member 21 of the pressure valve comes to rest. In a known manner, the valve closing member has vane-shaped guide faces 23, which are guided in the axial bore 24 of the valve seat body 14 and between which fuel can flow through to the valve seat. Between the conical sealing face 20 and the guide faces 23, the valve closing member comprises a cylinder 25, which is considerably reduced in diameter as compared with the diameter of the bore 24. In the vicinity of the cylinder 25, the valve closing member has a collar 26, which is fitted into the bore 24 of the valve seat body. On its outer circumference, the collar 26 has a polished face 27, which provides a throttle connection between the portion of the cylinder nearer the guide faces and the portion nearer the sealing face.

The valve closing member 21 also has a coaxial relief conduit 28, which at one end has an exit 30 at the portion of the cylinder 25 nearer the guide faces and on the other end discharges centrally at the end face of a protrusion 31. The protrusion 31 is seated on an end face 32 of the valve closing member which adjoins the sealing face 20 and is the inner limit of the valve closing member with respect to the interior of the recess 9.

The protrusion 31 serves to center a cup-shaped part 34, the cylindrical wall of which merges with an outer collar 35, which sits flush against the end face 32. The protrusion 31 protrudes into the cylindrical interior 36 of the cup-shaped part 34. Seated on the outer collar 35 is a closing spring 37, which is supported on the other end on the end face 38 of the recess 9; this closing spring 37 keeps the cup-shaped part 34 in positive engagement with the valve closing member 21 and tends to keep the valve closing member 21 with its sealing face 20 against the valve seat 19. The cup-shaped part 34 may, however, be connected to the valve closing member in some other manner instead, for instance via a welded seam.

A check valve 46 having a closing spring 40 is provided in the interior 36 of the cup-shaped part 34; it is supported at one end on the end face of the protrusion 31 and at the other end acts upon a valve plate 41, which serves to guide a ball-shaped valve closing member 42. The valve closing member 42 has a seat in a conical recess 43 on the bottom of the cup-shaped part, and this recess merges with a throttle 44, which discharges into the spring chamber 45 of the recess 9 which receives the pressure valve closing spring 37.

If during the operation of a fuel injection pump fuel is pumped to the injection valve 8, then under the influence of the pressure of the fuel delivered via the supply line 7, the valve closing member 21 is raised, in the manner shown in the drawing. Now if only a small quantity of fuel per unit of time is pumped, then it can flow through the throttle connection at the polished face 27, without the collar 26 having to emerge completely from the bore 24. The valve is raised only slightly, as shown in the drawing; nevertheless, a pressure is built up in the supply line 7' which is above the opening pressure of the injection valve 8 and effects an injection. At the end of the supply stroke, the pressure collapses, so that under the influence of the valve closing spring 37 the valve closing member 21 is moved to the closing position. During this process, by means of the collar 26, which is also called a return-feed or reaspiration collar, fuel is reaspirated out of the area upstream of the valve seat 19, until the valve closing member attains the closing position. The return-feed quantity is reduced by the portion of the fuel that flows during this movement as a compensatory flow, via the throttle connection 27. In this way, by means of a withdrawal of fuel, a relief in the supply line between the valve closing member and the injection valve 8 is effected in a known manner.

After the closure of the valve closing member and the injection valve as a result of the interrupted fuel supply, pressure waves travel through the supply line 7 in a known manner, because of the dynamic conditions; these waves are reflected at the valve closing member 21 and travel back and forth between the injection valve and the valve closing member. These pressure waves are capable of attaining pressure values which are higher than the opening pressure of the injection valve, so that if supplementary measures are not taken, a post-injection of fuel can take place, as already explained. In particular, if a closure of the injection valve has already occurred, the mean pressure in the supply line is still higher, because of the dynamic pressure conditions, than the closing pressure of the injection valves. The peak pressures of the pressure waves are higher, the higher the total residual pressure in the supply line 7' remains after the closure of the valve closing member 21.

By means of the provision of a check valve 46, communication is established between the spring chamber 45, that is, the supply line 7', and the supply line 7 nearer the pump work chamber on the other side of the valve closing member 21, if the opening pressure of this check valve 46 is exceeded. A certain quantity of fuel can then flow away via the throttle 44, effecting a reduction of the pressure wave that has arrived. The wave subsequently reflected toward the injection valve has pressure values which are not above the opening pressure of the injection valve.

With larger fuel injection quantities and also at high rpm corresponding to high feed rates, the throttling effect of the throttle connection 27 is amplified in such a manner that the return-feed collar 26 emerges from the bore 24, and the fuel that is pumped can flow unthrottled into the spring chamber 45, bypassing the return-feed collar. In this case, upon the end of pumping the full valve closing member stroke is effective for a reaspiration or return feed of fuel. Here the relief collar substantially alone takes on the task of relieving the injection line, in order to prevent post-injections. The relief quantity then substantially amounts to a relief volume of the valve stroke multiplied by the free annular surface area of the end face of the relief collar 26. Furthermore, given the more-rapid stroke movement of the valve closing member, no significant compensatory quantities flow past via the throttle connection 27, so that the supply line is relieved to a maximal extent. Because of the large volumetric relief, the residual pressure in the supply line 7' is relatively low, so that the pressure waves can not attain only relatively small pressure peaks, which as a rule remain below the opening pressure of the injection valve 8. Higher pressure peaks are reduced, here again, by means of the check valve 46. Instead of being a polished face, the throttle conection 27 on the return-feed collar 26 may also be provided with the aid of an increased play between the collar 26 and the bore 24, or by means of bores in the collar 26 itself.

Now if an internal combustion engine is operated with a quiet operation device and if the collar 26 were to be tightly guided in the bore 24, then the closing member 21 would first have to execute its full stroke, corresponding to the relief stroke, before the connection between the supply line 7 and the supply line 7' would be established. Given the low feed rate [with a quiet operation device], the result would be a delayed instant of injection. Furthermore, however, especially upon the closure of the closing member, the supply line 7' would be relieved in the same manner as is done at partial load or full load, or at high feed rates. For a low feed rate during idling operation, this relief corresponds to a large displacement volume, which must first be filled before a pressure that corresponds to the opening pressure of the injection valve will be attained in the supply line 7'. Here again, a delay in injection would occur, and a correspondingly long pre-supply stroke of the pump piston would be necessary. This long pre-supply stroke, which because of the low feed rate brought about by the quiet operation device would be even longer than in the case of normal operation without a quiet operation device, necessitates the availability of a relatively long useful stroke in the injection pump, that is, the stroke which is effective for pumping fuel to the fuel injection nozzle. This useful stroke for idling is lost, however, to the useful stroke in the remaining load range. This makes it considerably more difficult to use a quiet operation device; that is, it necessitates a complicated pump structure with a long useful stroke.

With the embodiment of the relief collar provided here, it is attained that at low feed rates, in particular in the range of quiet operation, the supply line 7' is relieved only slightly. However, since at a high residual pressure level pressure oscillations which are above the opening pressure of the injection valve 8 can still occur in the supply line 7' even in this operating range, the check valve 46 is provided, by way of which the pressure peaks are reduced in this operating range. This is accomplished by providing that when the check valve 46 is opened, fuel can flow back to the pump work chamber through the throttle 44, the interior 36, and the relief conduit 35, emerging at the exit 30.

By means of the embodiment of the throttle connection, the dimensions of the relief collar or of the relief volume, and by the layout of the opening pressure of the check valve, a desired residual pressure supply line 7' can be maintained in the various operating ranges of the engine, without exceeding the opening pressure of the injection valves once they have closed. The opening pressure of the check valve is advantageously selected such that it is approximately equal to the injection valve closing pressure. Thus a very high standing pressure or residual pressure can be adhered to in the supply line, with the smallest possible displacement volume. In accordance with the adapted residual pressure, long injection times are obtained in the idling and quiet operation ranges, yet these times are not so long as they would be in the case of a pressure valve that had no check valve. In such a case [without a check valve], because of the throttle connection 27, very high residual pressures would remain in the supply lines 7' and thus very long injection times would result, times which would sometimes be prolonged still further by post-injections.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A pressure valve for installation in a supply line between a pump work chamber of a fuel injection pump and an injection valve in an internal combustion engine supplied by said fuel injection pump, comprising a valve seat body having a valve seat and a passageway in which a pressure valve closing member is guided, said closing member having a portion disposed between said valve seat and a compression spring supported in a fixed manner in a spring chamber, a sealing face on said closure member arranged to cooperate with said valve seat, a return-feed collar on said closure member arranged to pass into said passageway connected to said pump work chamber, a relief conduit in said closure member, a throttle member, said relief conduit arranged to be connected to said spring chamber via said throttle member, and to a part of said passageway being permanently connected to said pump work chamber upstream of said return-feed collar, said throttle member having a check valve, a closing spring means supported on said valve closing member and said return-feed collar being provided with a throttle means on its circumference arranged to connect adjacent parts of said passageway.

2. A pressure valve as defined by claim 1, further wherein said throttle means comprises a flattened area on the outer circumference of said return-feed collar.

3. A pressure valve as defined by claim 1, further wherein said pressure valve closing member further includes an annular end face provided with a protrusion, a cup-shaped part having an outer collar seated on said annular end face, said compression spring arranged to be supported on said outer collar, a chamber enclosed by said cup-shaped part, said cup-shaped part receiving said check valve, and a closing member adapted to control a throttle bore which extends through said cup-shaped part.

4. A pressure valve as defined by claim 2, further wherein said pressure valve closing member further includes an annular end face provided with a protrusion, a cup-shaped part having an outer collar seated on said annular end face, said compression spring arranged to be supported on said outer collar, a chamber enclosed by said cup-shaped part, said cup-shaped part receiving said check valve, and a closing member adapted to control a throttle bore which extends through said cup-shaped part.

5. A pressure valve a defined by claim 3, further wherein said cup-shaped part includes a bottom and said throttle bore is disposed in said bottom.

6. A pressure valve as defined by claim 4, further wherein said throttle bore further includes a divergent area arranged to form a valve seat in said closing member of said check valve and said closing spring means of said check valve supported on a protrusion of said closing member.

7. A pressure valve as defined by claim 3, further wherein said closing member of said check valve comprises a ball which is guided in a spring plate.

8. A pressure valve as defined by claim 1, further wherein opening pressure of said check valve is approximately equal to the closing pressure of said injection valve.

9. A pressure valve as defined by claim 2, further wherein opening pressure of said check valve is approximately equal to the closing pressure of said injection valve.

* * * * *